US007901265B1

(12) United States Patent
Cameron et al.

(10) Patent No.: US 7,901,265 B1
(45) Date of Patent: Mar. 8, 2011

(54) ELECTROMECHANICAL TOY

(75) Inventors: Don Cameron, Riverside, RI (US); Mark A. Poirier, Hubbardston, MA (US); Richard J. Maddocks, Barrington, RI (US)

(73) Assignee: Hasbro, Inc., Pawtucket, RI (US)

( * ) Notice: Subject to any disclaimer, the term of this patent is extended or adjusted under 35 U.S.C. 154(b) by 508 days.

(21) Appl. No.: 11/846,458

(22) Filed: Aug. 28, 2007

Related U.S. Application Data

(63) Continuation-in-part of application No. 10/698,930, filed on Nov. 3, 2003, now Pat. No. 7,364,489, which is a continuation-in-part of application No. 10/425,992, filed on Apr. 30, 2003, now Pat. No. 6,843,703.

(51) Int. Cl.

| | |
|---|---|
| ***A63H 3/20*** | (2006.01) |
| ***A63H 3/46*** | (2006.01) |
| ***A63H 11/00*** | (2006.01) |
| ***A63H 13/00*** | (2006.01) |

(52) U.S. Cl. ..... 446/330; 446/353; 446/376

(58) Field of Classification Search ..... 446/330, 446/352–356, 376, 484

See application file for complete search history.

(56) References Cited

U.S. PATENT DOCUMENTS

| | | | | | |
|---|---|---|---|---|---|
| 1,345,052 | A | | 6/1920 | Williams | |
| 1,601,983 | A | | 10/1926 | Savage | |
| 1,782,477 | A | * | 11/1930 | Price | 446/356 |
| 2,641,865 | A | | 6/1953 | Gowland | |
| 3,164,924 | A | | 1/1965 | Iwaya et al. | |
| 3,199,248 | A | | 8/1965 | Suzuki | |
| 3,443,338 | A | * | 5/1969 | Collins | 446/301 |
| 3,911,613 | A | * | 10/1975 | Morrison et al. | 446/338 |
| 4,878,875 | A | * | 11/1989 | Pin-Hung et al. | 446/356 |
| 4,913,676 | A | * | 4/1990 | Koguchi et al. | 446/300 |
| 5,052,969 | A | * | 10/1991 | Smith | 446/268 |
| 5,141,464 | A | * | 8/1992 | Stern et al. | 446/338 |
| 5,224,896 | A | * | 7/1993 | Terzian | 446/355 |
| 5,695,382 | A | * | 12/1997 | Lin | 446/354 |
| 5,876,263 | A | * | 3/1999 | DeCesare et al. | 446/330 |
| 6,273,782 | B1 | * | 8/2001 | Chan et al. | 446/356 |
| 6,661,239 | B1 | | 12/2003 | Ozick | |
| 6,672,934 | B2 | * | 1/2004 | Hornsby et al. | 446/300 |
| 6,695,672 | B1 | * | 2/2004 | Rehkemper et al. | 446/298 |
| 6,843,703 | B1 | * | 1/2005 | Iaconis et al. | 446/371 |
| 6,940,291 | B1 | | 9/2005 | Ozick | |
| 7,364,489 | B1 | * | 4/2008 | Iaconis et al. | 446/330 |
| 2004/0132378 | A1 | * | 7/2004 | Su | 446/330 |

* cited by examiner

*Primary Examiner* — Gene Kim
*Assistant Examiner* — Alyssa M Hylinski
(74) *Attorney, Agent, or Firm* — Perry Hoffman

(57) ABSTRACT

A toy drive mechanism having extensions such as leg and neck members covered with a plush covering. The drive mechanism is operative to move the leg, back, and head members in coordinated movements imitating an animal tugging or pulling on a rope. The realistic movement is provided by a series of rotating devices, some on differing axes relative to the drive shaft, and an information processor activated by one or more switches located throughout the body. One switch in particular, located between the neck and head and motivated by a user pulling on the rope in the toy's mouth, will cause the toy to exert a pulling motion accompanied by sound effects.

4 Claims, 21 Drawing Sheets

ELECTROMECHANICAL TOY

CROSS-REFERENCE TO RELATED APPLICATION

This application claims priority from and is a continuation-in-part of U.S. application Ser. No. 10/698,930 filed Nov. 3, 2003, titled "Electromechanical Toy," which claims priority from and is a continuation-in-part of U.S. application Ser. No. 10/425,992 filed Apr. 30, 2003, now U.S. Pat. No. 6,843,703 titled "Electromechanical Toy," which is incorporated herein by reference.

BACKGROUND OF THE INVENTION

1. Field of the Invention

The present invention relates to electromechanical toys or dolls. More particularly, the invention relates to a doll featuring realistic movements in response to a user's interaction.

2. Description of the Related Art

Toys and dolls that have moving parts are well known. For example, dolls and plush toys such as stuffed animal are made with moveable appendages. However, the movement of a doll's appendages is limited by the technology available. The result is often a doll that, while able to interact with a user, does not do so in a way that is life-like or realistic.

As with technology, consumer demands are constantly evolving. The ability for toys to capture the evolving technology into toys that can interact with the user through life-like mannerisms characteristic of the animal the toy is attempting to imitate is a realistic concern of the toy industry.

To imitate a life-like animal, the toy must be capable a capturing two distinct aspect. One is the imitation of the mannerisms displayed by the animal, which must be accomplished through a system of inexpensive linkages and gears as cost is a constant restriction on the toy industry. With the cost constraint ever present, modern toys often lack the innate intricacies of the subtle movements of living animals.

The second aspect inherent in creating a lifelike toy is creating a triggering mechanism to activate the toy that does not disrupt the fantasy aspect of the user. Current toys often feature simple on/off switches, which reduce the ability for a child to make-believe the toy is alive. Reduction of this disruption increases the user's interaction with the toy, consequently, increasing the entertainment value of the toy.

A need exists, therefore, to create a toy capable of exhibiting realistic mannerisms characteristic of the animal the toy is attempting to imitate, while being actuated in a way that is inherent to a user's interaction with the animal such as tugging on a rope in a dog's mouth causing the dog to respond by tugging back on the rope and growling.

SUMMARY OF THE INVENTION

The present invention solves the aforementioned needs by creating a toy or doll comprising a drive mechanism with a plurality of extensions such as leg and neck members covered with a plush covering configured to closely resemble a live animal and to respond to stimuli in a realistic manner that is consistent with the way in which a real animal would respond.

In particular, an embodiment of the present invention resembles a dog holding a rope in the dog's mouth. Tugging on a rope by the user will cause the dog to respond by tugging back on the rope and growling. The realistic motion is accomplished through the use of a pair of legs exhibiting a kneading motion that raises and lowers the dog's body. The tugging motion by the dog is actuated through a sensor in the dog's neck responsive to a user pulling on the rope in the dog's mouth. To compliment the realism of the invention an information processor coordinates the movements with sound effects such as growling typical of a live dog at play.

In general, the toy includes a body, a motor within the body, an appendage coupled to the body of the toy, and a neck device coupled to the body of the toy. The appendage is actuated by the motor to move along a first path. The neck device is actuated by the motor to move along a second path.

To achieve the realistic movement needed, movement of the neck device and the appendage may occur simultaneously and in coordinated movement by an information processor housed within the body.

To create the movements in the appendage, the toy may incorporate a drive shaft that couples the motor to the appendage. The toy may further include a cam that receives the drive shaft such that rotation of the drive shaft rotates the cam. The toy may also include an eccentric rod to which the appendage connects.

The toy may also include a pivot gear coupled to the body of the toy and a post that couples to a slot within the appendage. The toy may include gear teeth that extend from the cam and that mesh with gear teeth of the pivot gear such that rotation of the cam causes rotation of the pivot gear, which causes the appendage to move along the first path.

The toy may include a linkage rod coupled to the body of the toy and to a slot within the appendage. Rotation of the cam causes the appendage to move along the first path.

These mechanisms can present a realistic kneading action by the appendages in the toy.

The drive shaft may couple the motor to the neck device. The toy may include a head connected to the neck device. The neck device may include a hinge attached to the body such that the neck device is configured to rotate about the hinge as the neck device moves along the second path. The toy may include a follower attached to the neck device and coupled to the drive shaft such that rotation of the drive shaft moves the follower in a periodic pattern and causes the neck device to move along the second path. There may also be a hinge present at the connection of the head to the neck device such that the head is configured to rotate about the hinge as the neck device moves along the second path. The connection of the head and neck device may also be coupled to allow the radial movement of the head.

The toy may include an information processor within the body and coupled to the motor, and a sensor connected to send a signal to the information processor. The information processor causes the motor to operate in response to a signal from the sensor.

The toy may include another appendage shaped like the appendage and coupled to the body of the toy. Each of the appendages may be positioned such that ends of the appendages move in non-circular paths that are aligned with each other.

Movement along the first path may include movement of an end of the appendage along a non-circular path.

The toy may also include a flexible skin surrounding the body of the toy. The flexible skin may include pile that resembles an animal's coat. The flexible skin may surround the appendage of the toy and may move as the appendage moves.

The drive mechanism is operative to move the leg, back, and head members in coordinated movements imitating an animal tugging or pulling on a rope. To achieve this realistic movement, a series of rotating devices, some on differing axes relative to the drive shaft, are employed.

The information processor activated by a plurality of switches located throughout the body coordinates the toy.

One switch in particular, located between the neck and head and motivated by a user pulling on the rope in the toy's mouth, will cause the toy to exert a pulling motion accompanied by sound effects.

DETAILED DESCRIPTION OF THE PREFERRED EMBODIMENTS

Figure 1:
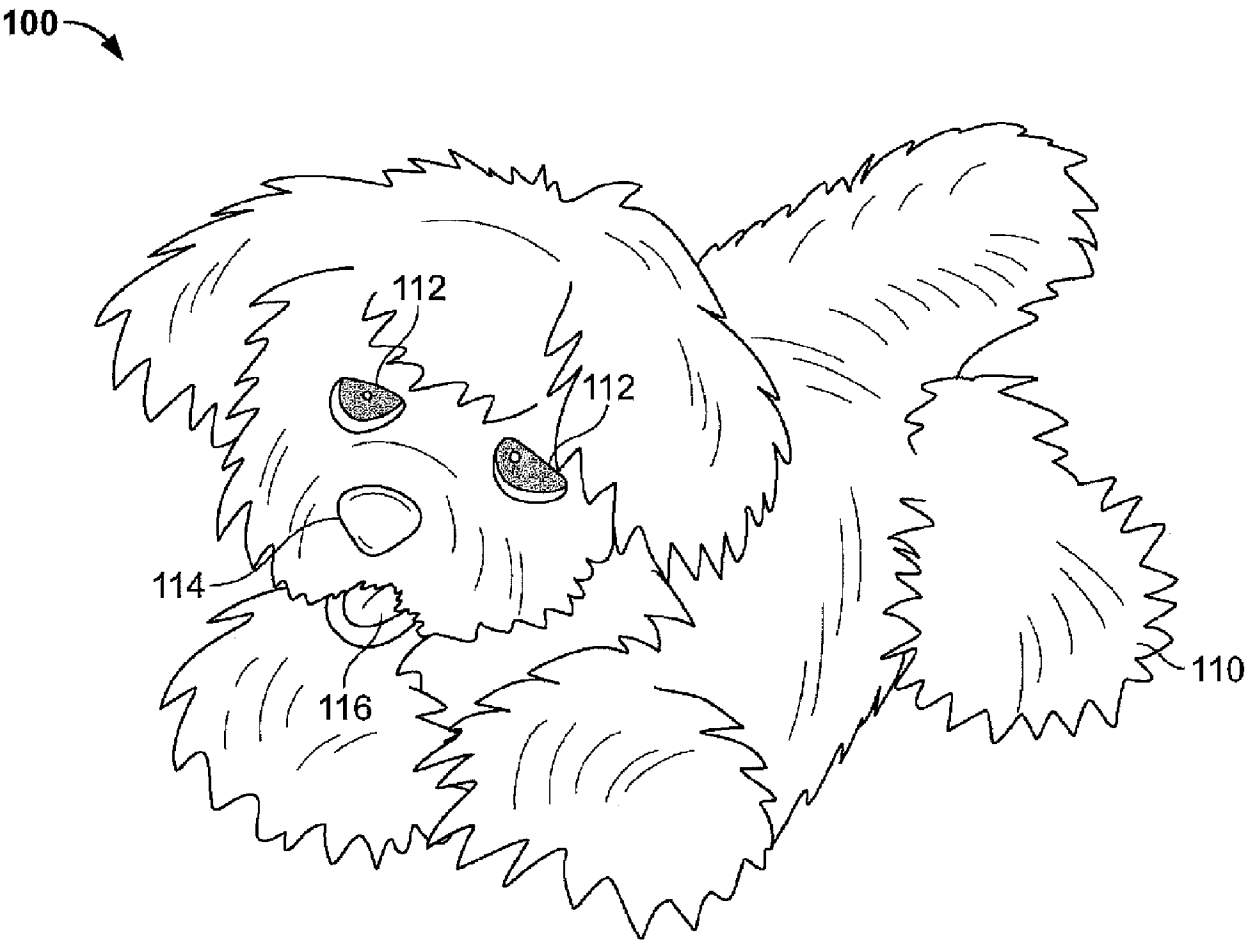
FIG. 1 is a perspective view of a toy.

Referring to FIG. 1, a toy 100 is designed to provide realistic movement in response to a sensed condition. To this end, the toy 100 includes an external flexible skin 110. The external flexible skin 110 may be made of a resilient material that is covered with one or more external soft layers, such as pile that resembles an animal's coat. As shown, the toy 100 is in the shape of a puppy and the external flexible skin 110 resembles the coat of a puppy. The external flexible skin 110 has an opening 112, an opening 114, and an opening 116 formed into the skin to facilitate the fitting of the external flexible skin 110 over an internal structure, 200, as shown in the alternative embodiments of FIGS. 2A and 2B.

Figure 2A:
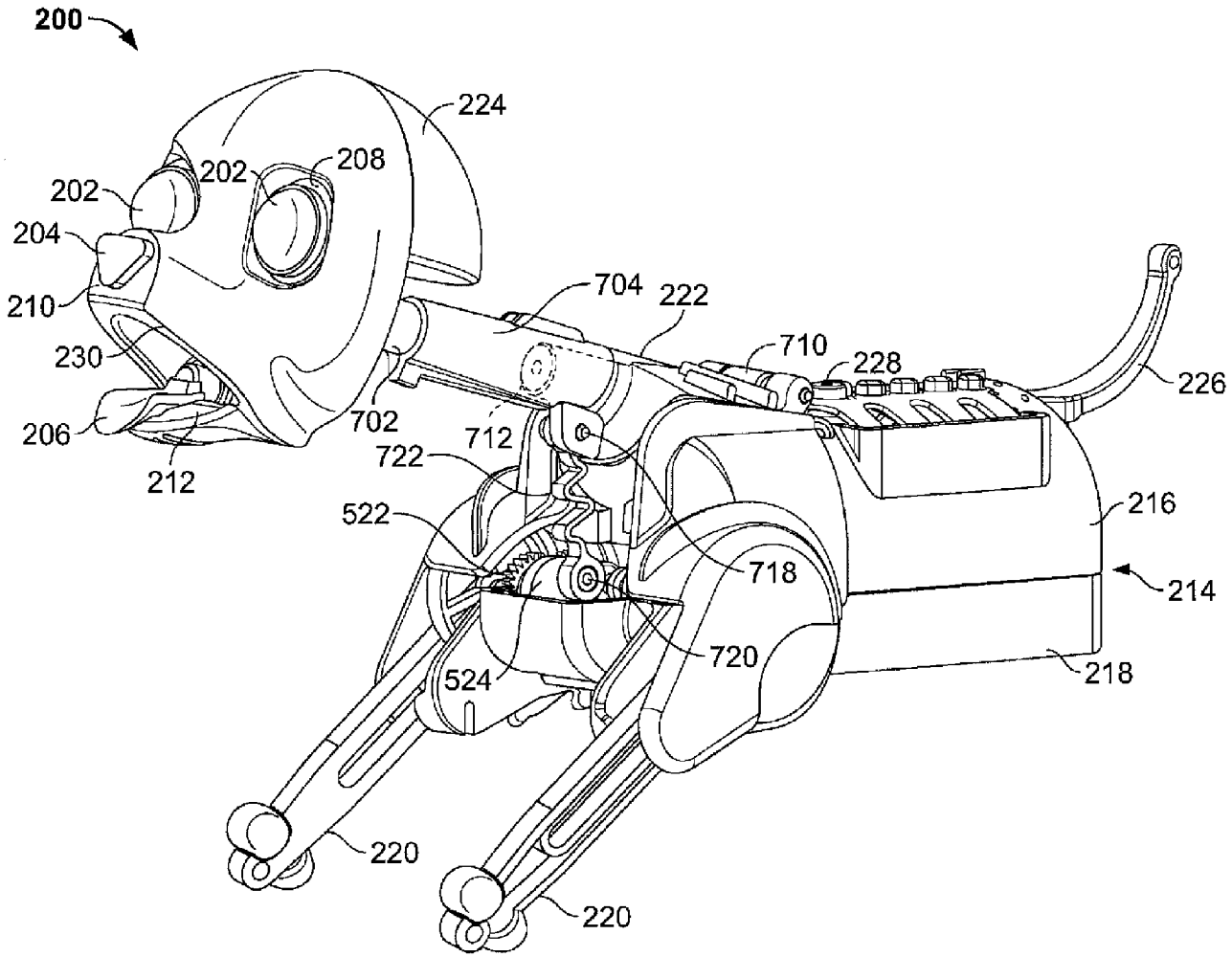
FIG. 2A is a perspective view of an internal structure of an alternative embodiment of the toy of FIG. 1.
Figure 2B:
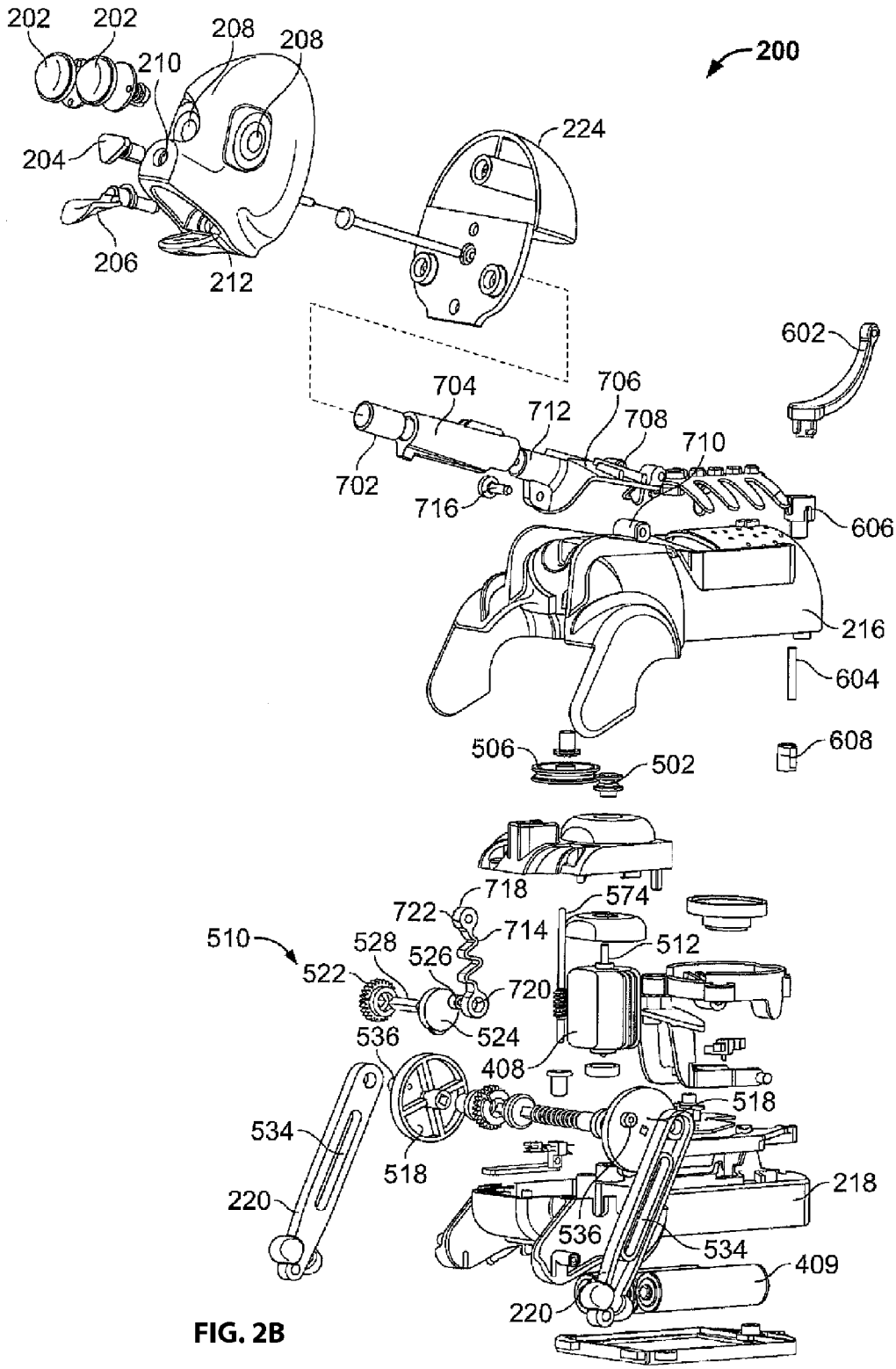
FIG. 2B is an exploded perspective view of the internal structure of FIG. 2A.

As shown in FIGS. 2A and 2B, posts shaped as, for example, eyes 202, a nose 204, and a tongue 206 inter-fit with cavities 208, a cavity 210, and a cavity 212, respectively, of the internal structure 200 to secure the external flexible skin 110 to the internal structure 200. The posts consist of a wider portion and a narrower portion. The flexible skin 110 is placed over the internal structure 200 such that the openings 112, 114, and 116 fit over the cavities 208, 210, and 212, respectively. The narrower portions of the eyes 202, nose 204, and tongue 206 are inserted into the cavities 208, 210, and 212, respectively. The wider portions of the posts hold the flexible skin 110 in place.

The internal structure 200 includes a body 214 which can be separated into a top portion 216 and a bottom portion 218. The bottom portion 218 houses many of the components that control operation of the toy 100. Connected to these components are one or more appendages 220, as well as a neck device 222 for connecting the body 214 to a head 224, and a tail device 226. The internal structure 200 may be made of any suitable combination of materials. For example, the body 214 and the appendages 220 may be made of plastic and/or metal.

Any combination of the appendages 220, a first extension 220 and a second extension 220 in the present embodiment, the neck device 222, a third extension 222 in the present embodiment, and the tail device 226 may be actuated during operation of the toy 100 in response to input received from one or more input devices in the form of sensors 228 and 230. The first extension 220 is motivated to rotate around a first axis, or appendage axis. Likewise, the second extension 220 is motivated about a second axis, which in the present embodiment is parallel and also known as an appendage axis. The third extension 222 reciprocates about a third axis, or neck axis, which in the present embodiment is also parallel to the first axis. In the present embodiment, the head 224 is coupled to the neck device 222 to allow radial movement about the third extension 222. This allows the head 224 to rotate in along a fourth axis, or head axis, that, in the present embodiment, is perpendicular to the third axis.

Figure 3A:
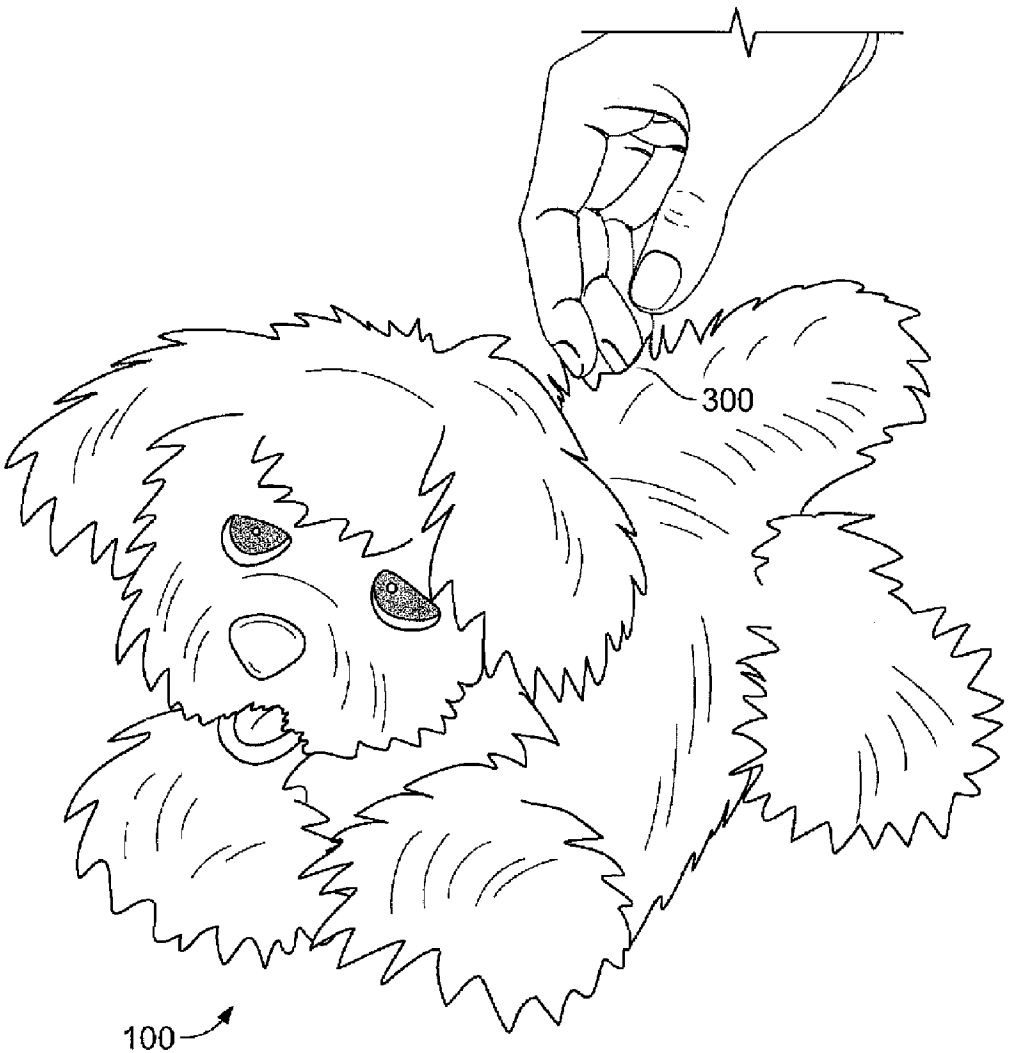
FIGS. 3A and 3B are perspective views of an alternative embodiment of the toy of FIG. 1.
Figure 3B:
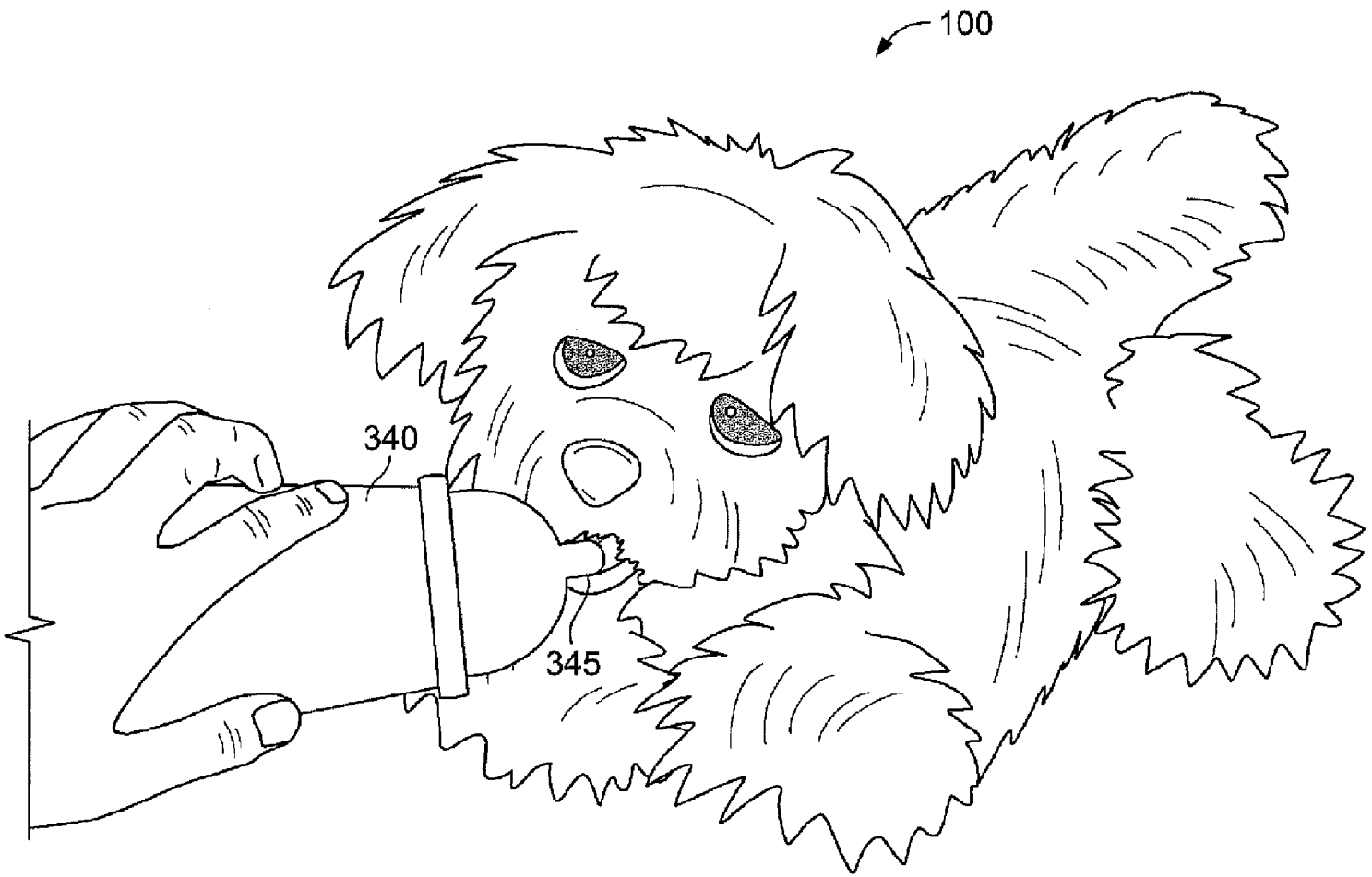

Referring also to FIG. 3A, the sensor 228 is a pressure sensitive switch that is depressed and pushes an underlying button switch when a user touches the toy 100 at a location 330 near the sensor 228. Referring also to FIG. 3B, the sensor 230 is a magnetic switch, such as, for example, a reed switch or a Hall effect sensor, that is actuated by a magnet within an accessory 340 when the accessory 340 is placed at a location 345 near the sensor 230.

Figure 3C:
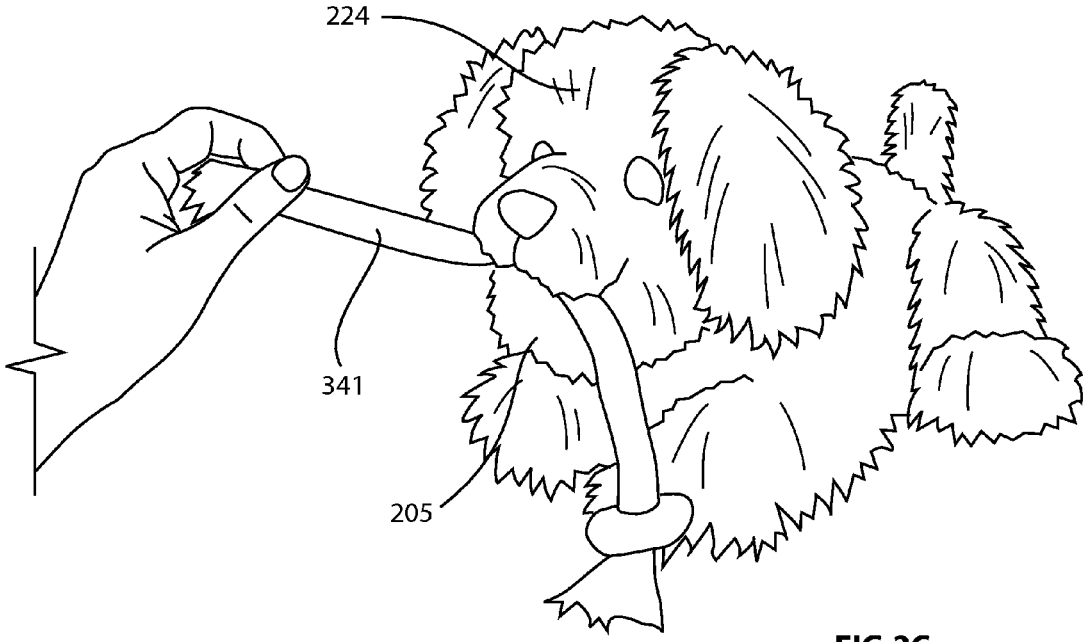
FIG. 3C is a perspective view of a present embodiment of the toy.

As shown in FIG. 3C, in the present embodiment, a rope 341 can be placed at the head 224 of the toy. The head 224 includes a lower jaw 205 for receiving the rope 341 and compressing the rope 341 against the head 341 to prevent removal when a user is pulling on the rope 341.

Figure 4:
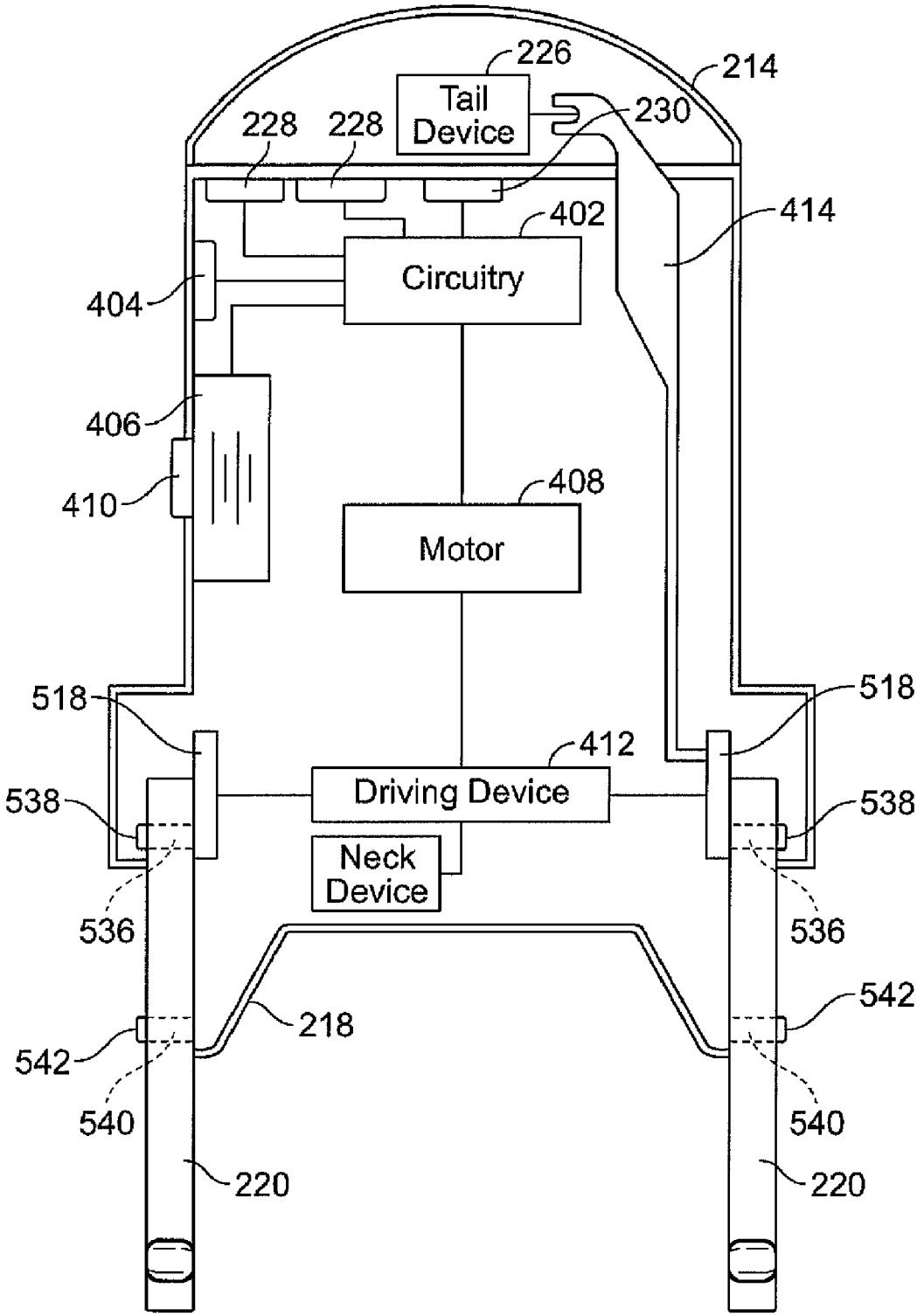
FIG. 4 is a block diagram of the toy of FIG. 1.

As shown in FIG. 4, internal circuitry 402 and an output device in the form of an audio device 404 are housed within the body 214. The sensors 228 and 230 and the audio device 404, a speaker in the present embodiment are connected to the circuitry 402, an information processor in the present embodiment. The circuitry 402 receives power from an energy source 406 and controls operation of a motor 408 housed within the body 214. The energy source 406 may be provided by batteries 409, shown in FIG. 2B, that are placed within a compartment on an underside of the body 214. The circuitry 402 is turned off and on by a switch 410 that is accessible on the body 214. A driving device 412 that is housed within the body 214 couples the motor 408 to the neck device 222, the appendages 220, and the tail device 226, which is attached to one appendage 220 by a long connector piece 414.

Figure 5:
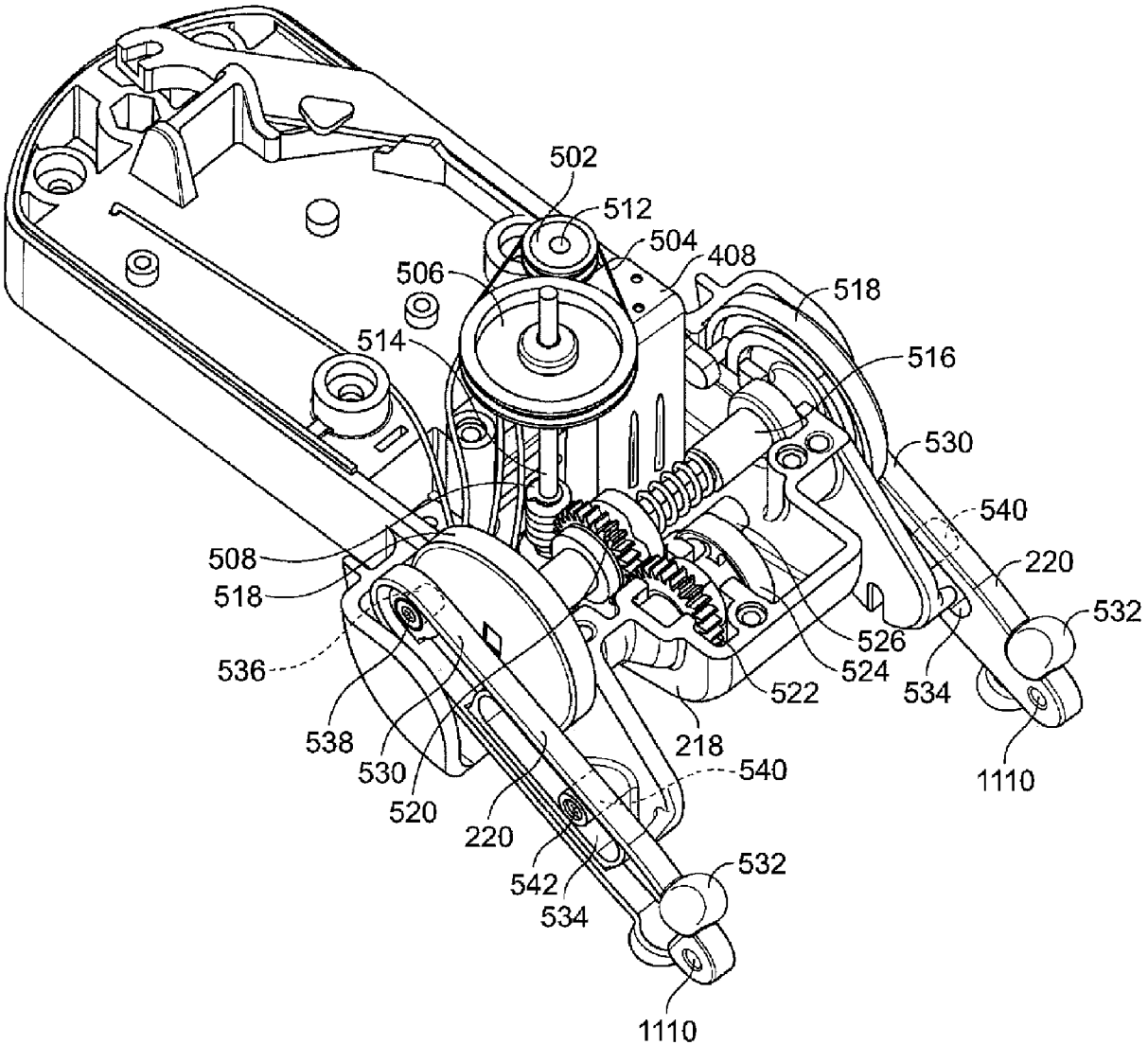
FIG. 5 is a perspective view of an interior of a bottom portion of the internal structure of the toy of FIG. 1.

Referring to FIG. 5, the motor 408 includes a pulley 502, a flexible belt 504, a pulley 506, a worm gear 508, and a shaft system 510 (discussed below). The pulley 502 is mounted on and frictionally engages a shaft 512 of the motor 408. The flexible belt 504 is connected to the pulley 502 and the pulley 506, such that rotation of the pulley 502 causes rotation of the pulley 506. The pulley 506 and the worm gear 508 are mounted on and fixed to a shaft 514 that is connected the body 214.

Referring also to FIGS. 2B, 5, and 6, the drive shaft system 510 includes a disk shaft 516 that spans the width of the bottom portion 218 and is connected to centers of a pair of cams 518. The shaft system 510 also includes a gear 520 that is fixed on the disk shaft 516 and coupled to the worm gear 508. The shaft system 510 includes a gear 522 having teeth that mate with teeth of the gear 520 and a rounded piece 524 having an eccentric protrusion 526. The gear 522 and the rounded piece 524 are mounted to a shaft 528 (shown in FIG. 2B).

Each of the first extension 220 and second extension 220 includes a first end 530, a second end 532, and a slot 534 that extends between the first and second ends 530 and 532. In the present embodiment, the first cam 518A attached to the first extension 220A acts as a first rotating device 518A. Likewise, in the present embodiment, the second cam 518B attached to the second extension 220B acts as a second rotating device 220B. The cams 518 couple the appendages 220 to the disk shaft 516. Each cam 518 includes an eccentric rod 536 that is positioned along and is integral with an outer surface of the cam 518. The first end 530 of the appendage 220 includes a first screw 538 for connecting the eccentric rod 536 to the appendage 220.

The bottom portion 218 of the body 214 includes a linkage rod 540 that is positioned along and integral with an outer surface of the bottom portion 218. The slot 534 of the appendage 220 is wide enough to accommodate the linkage rod 540, which is engaged with the slot 534. The linkage rod 540 is constrained to the slot 534 by a second screw 542.

The first end 530 of the appendage 220 is rotatably fixed to the eccentric rod 536 and the second end 532 of the appendage 220 is free to move along paths constrained by the engagement of the linkage rod 540 with the slot 534 and the second screw 542. In this way, overall motion of the appendage 220 is constrained by the engagement of the slot 534 with the fixed linkage rod 540 and by the fixed connection of the first end 530 to the eccentric rod 536.

Figure 6A:
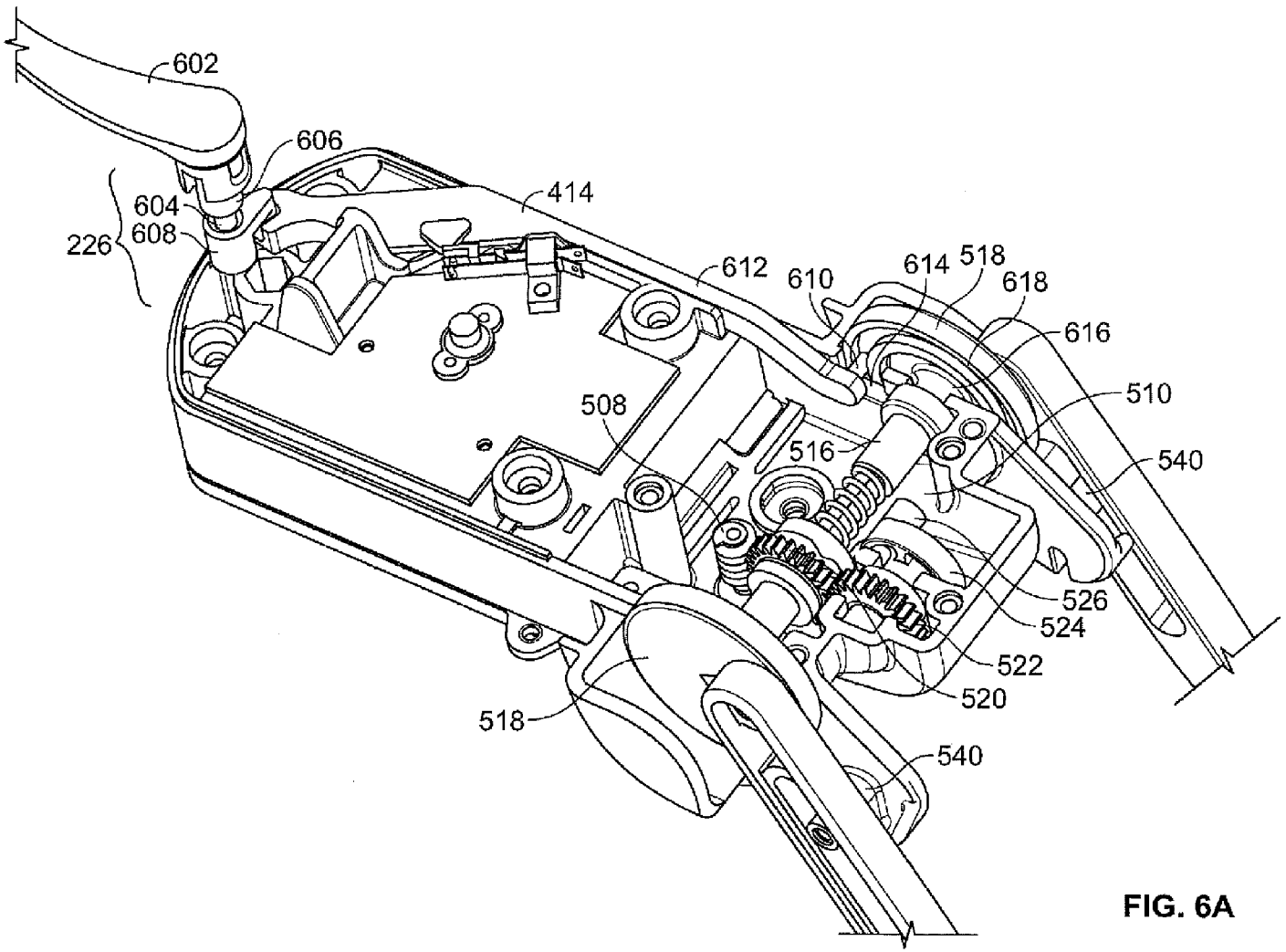
FIG. 6A is a perspective view of the internal structure including a tail device of the toy of FIG. 1.

Referring to FIG. 6A, the tail device 226 includes a tail-shaped piece 602, a shaft 604 extending from the tail-shaped piece 602, a middle piece 606 fixed to the shaft 604, and a lower piece 608 fixed to the shaft 604. The tail device 226 is coupled with the disk shaft 516 through a long connector piece 414.

Figure 6B:
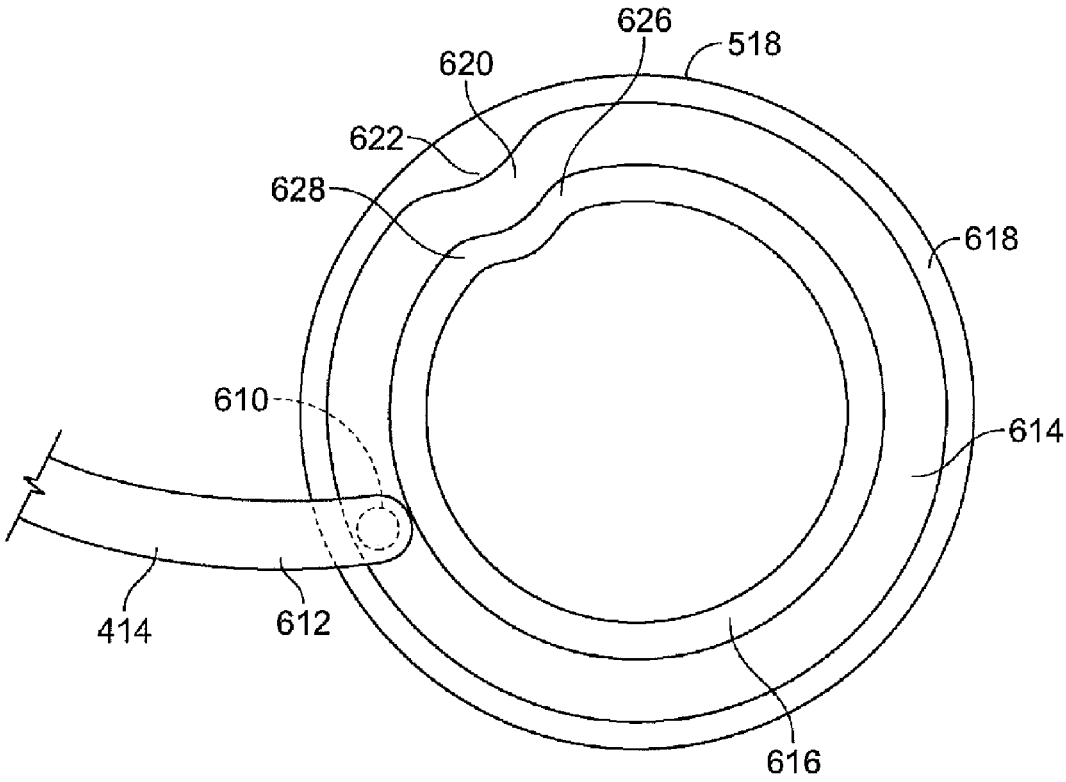
FIG. 6B is a side view of a part of the tail device of the toy of FIG. 1.

Referring also to FIG. 6B, the long connector piece 414 includes a shaft 610 that protrudes from an end 612 of the piece 414 and fits within a groove 614 of one of the cams 518. The groove 614 is created by an inner wall 616 and an outer wall 618 of the cam 518. The groove 614 is circular except for a shallow u-shaped curve 620 caused by a protrusion 622 in the outer wall 618 and a dimple 624 in the inner wall 616.

Figure 7A:
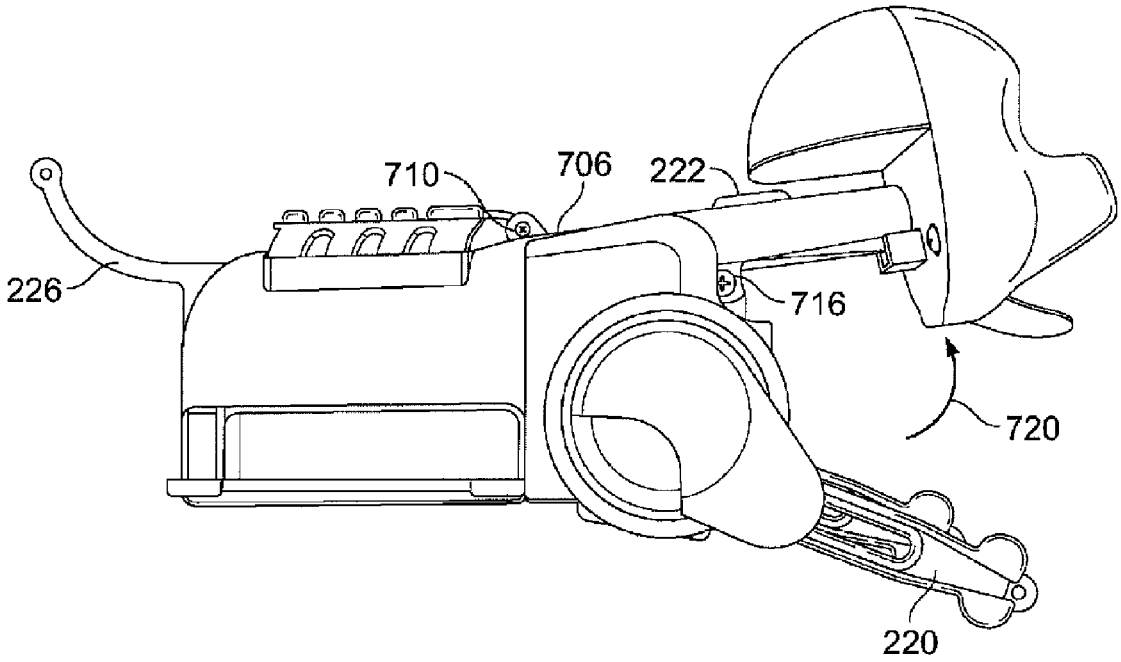
FIGS. 7A and 7B are side views of the internal structure of an alternative embodiment of the toy of FIG. 1.
Figure 7B:
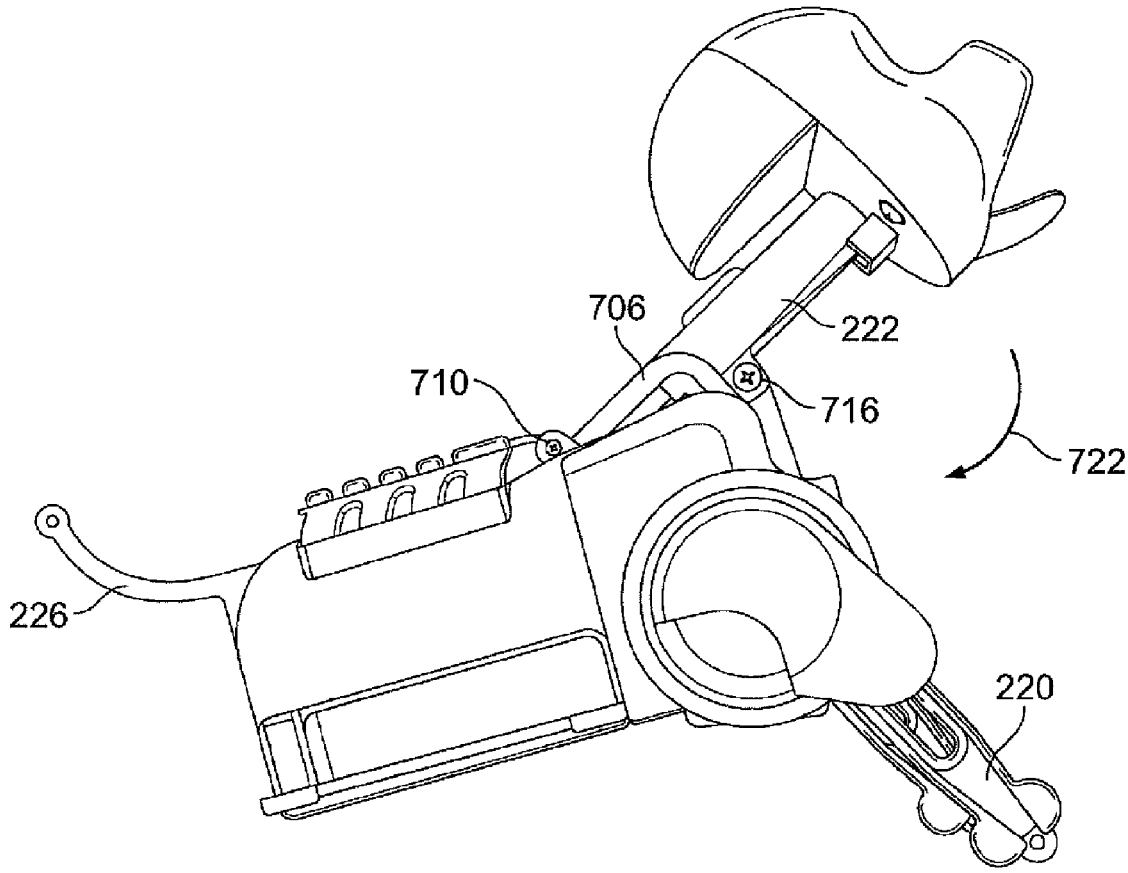

Referring to FIGS. 2B, 7A and 7B of an alternative embodiment, the neck device 222 includes a first piece 702 attached to the head 224, a second piece 704 attached to the first piece 702, and a third piece 706 attached to the second piece 704.

Figure 2C:
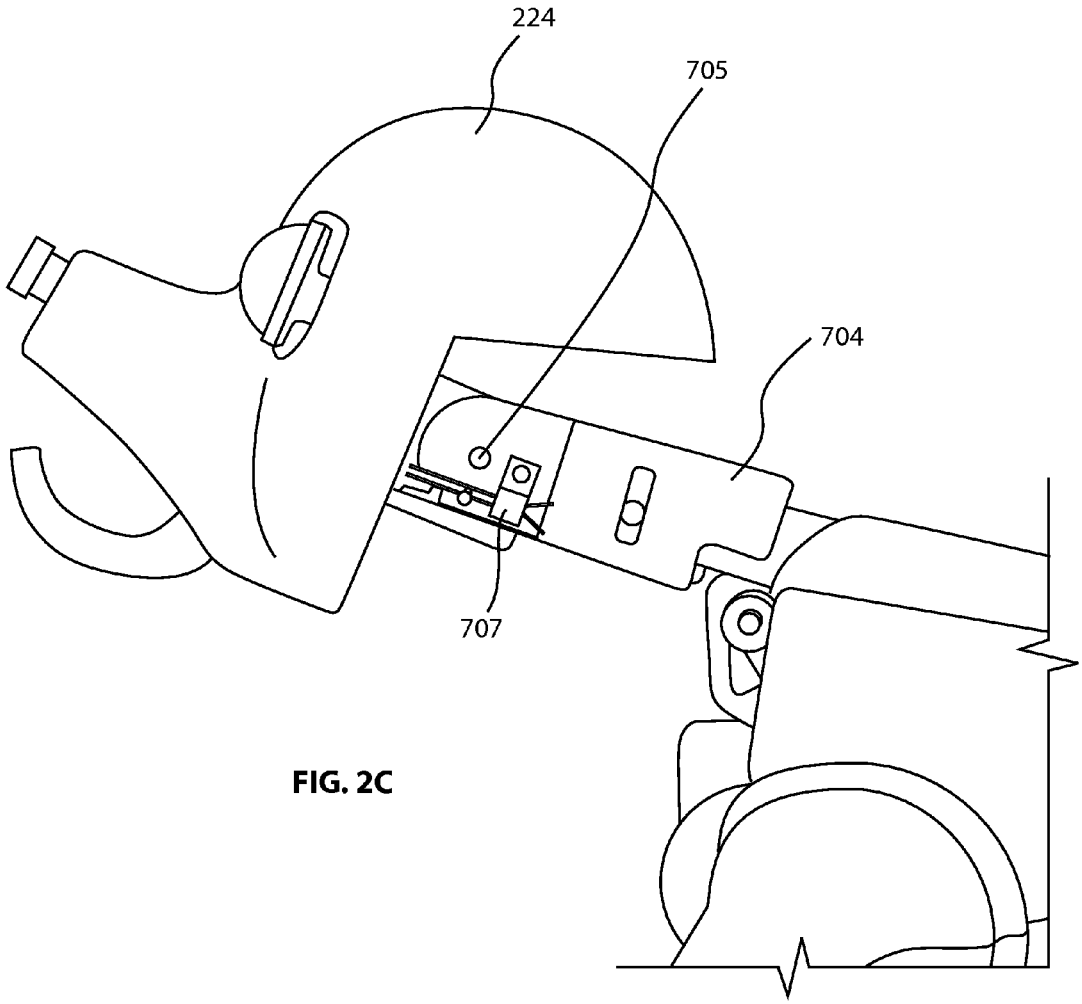
FIGS. 2C and 2D are views illustrating is a present embodiment of the toy.
Figure 2D:
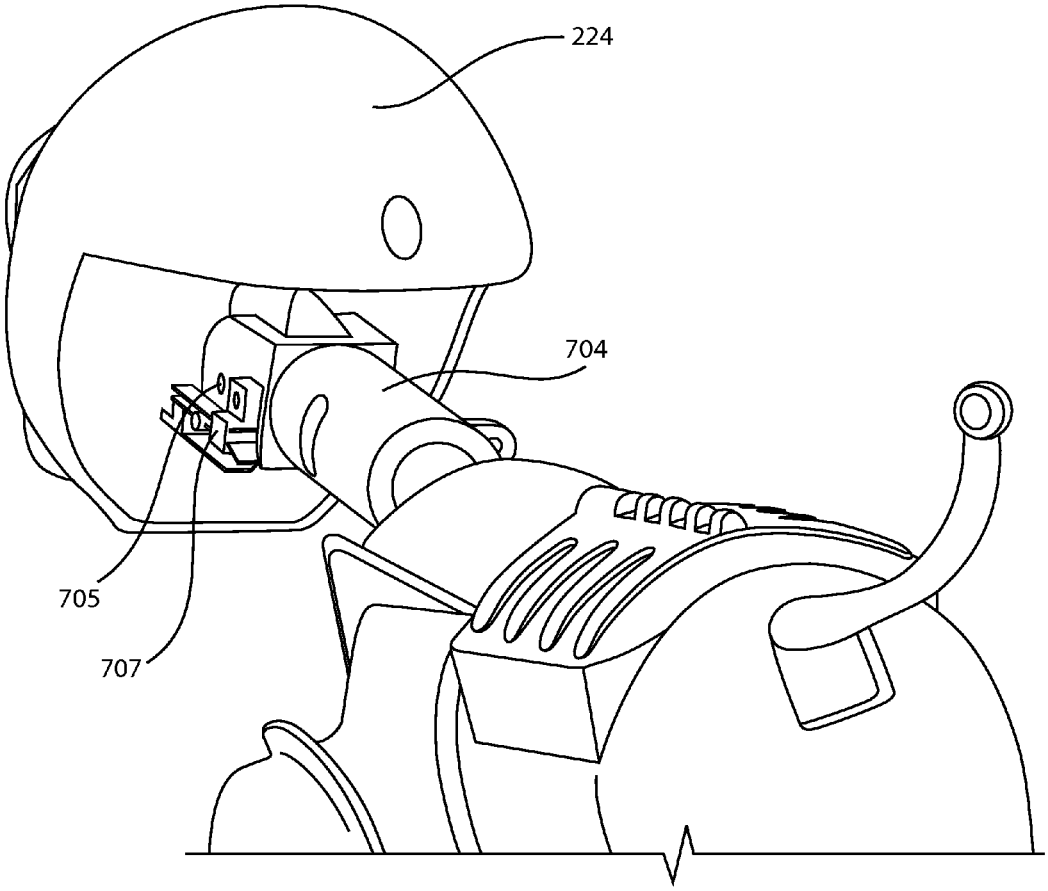

In the preferred embodiment, as shown in FIGS. 2C and 2D, the second piece 704 connected to the head 224 by connection 705. Connection 705 could be an assortment of connection types that allow for movement such as a pivot, joint, or hinge as in the present embodiment that allows for the head 224 to move in along a fifth axis, or hinge axis, perpendicular to the fourth axis. Located at connection 705, is switch 707. Activation of switch 707 occurs when the head 224 is motivated in the dorsal direction. Switch 707 is connected to driving device 412, which will coordinate the neck device 222 into a tugging motion and appendage 220 into a kneading motion when activated. The activation of switch 707 will likewise trigger audio system 404 to issue sound effects that are coordinated with the movements of the neck device 222 and the appendage 220 through the internal circuitry 402 acting as an information processor, microprocessor, or controller.

In an alternative embodiment, as shown in FIG. 2B, one end 708 of the third piece 706 is attached to the top portion 216 at a hinge 710. Another end 712 of the third piece 706 is attached to a follower 714 by a bolt 716. The follower 714 is shaped with a first hole 718 for receiving the bolt 716 and a second hole 720 for connecting with the protrusion 526 of the rounded piece 524. The follower 714 includes a middle pliable portion 722 having a zigzag shape between the holes 718 and 720.

Figure 8:
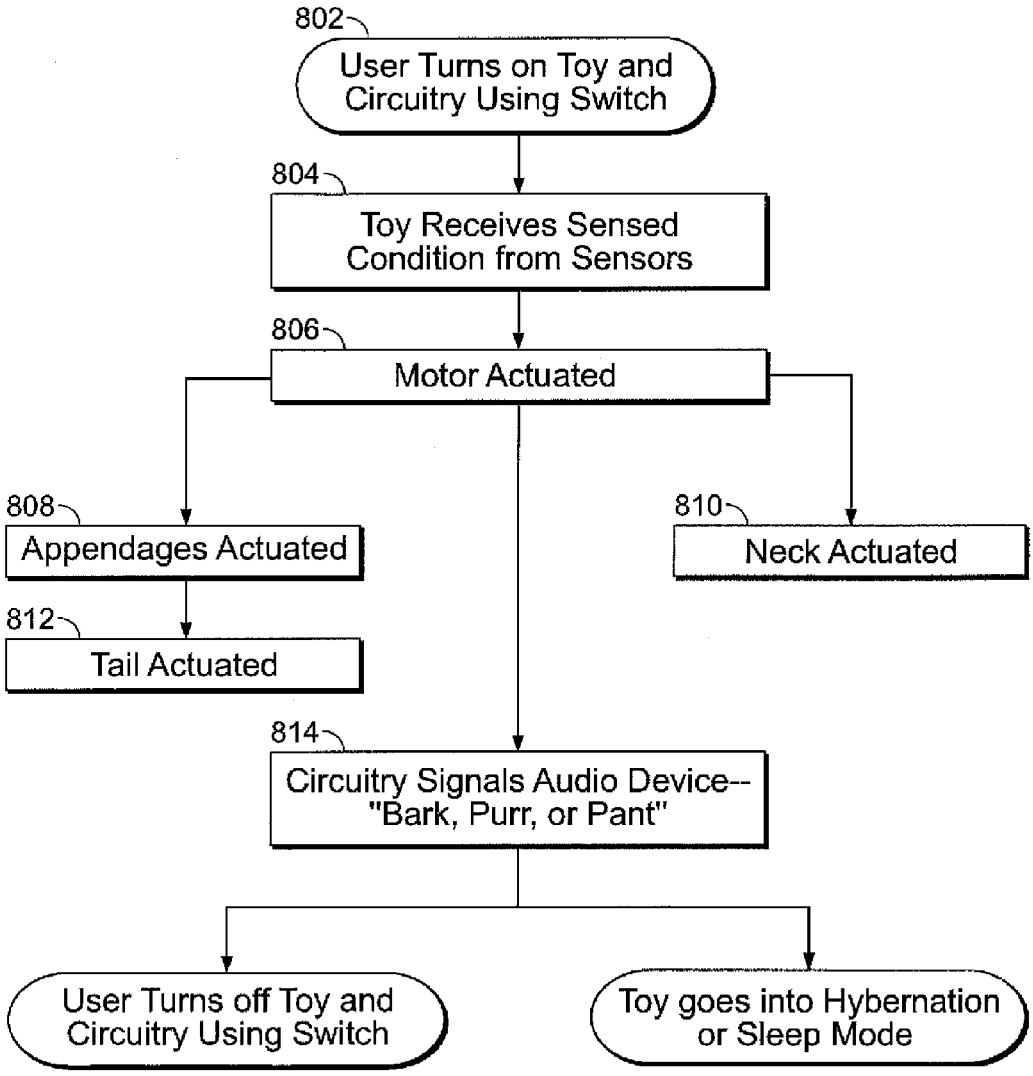
FIG. 8 is a flow chart of a method of operating the toy.
Figure 9A:
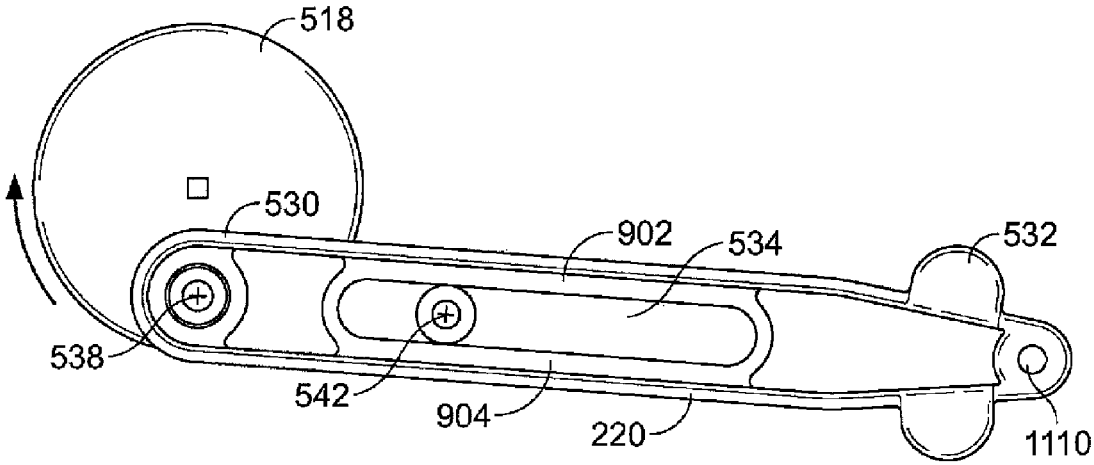
FIGS. 9A-9G are side views of an appendage of the internal structure of FIG. 2A.
Figure 9B:
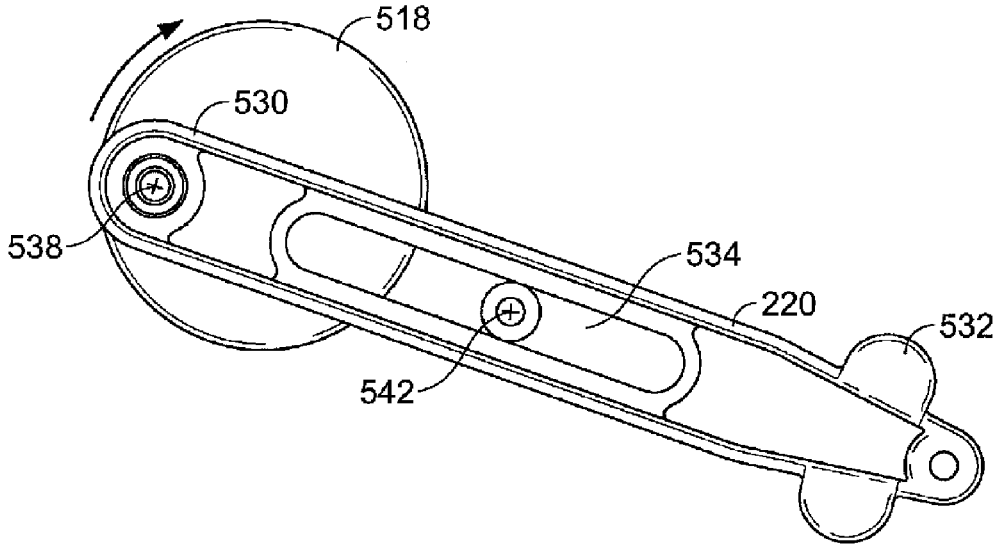
Figure 9C:
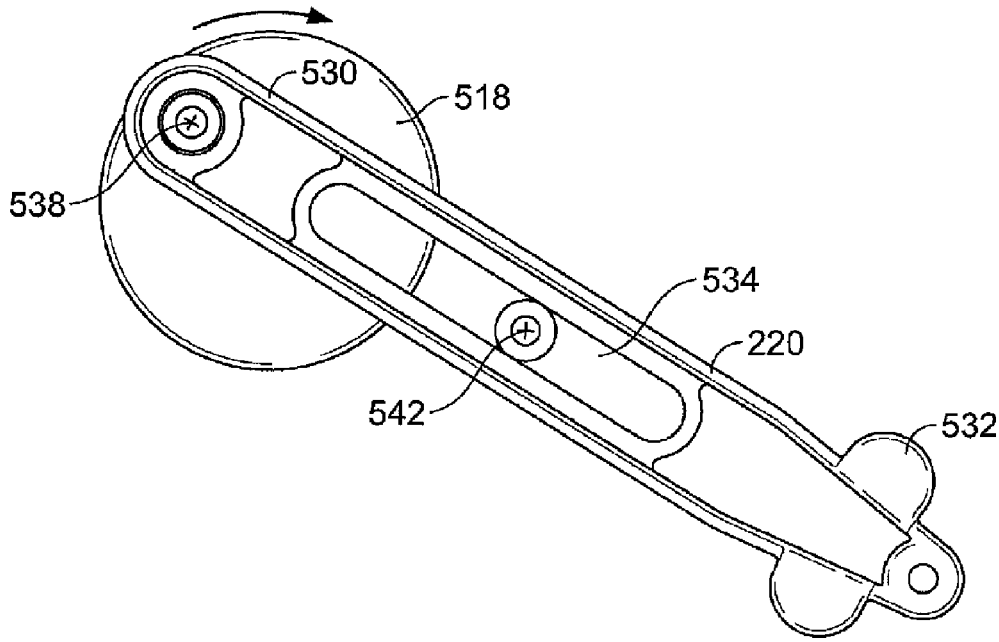
Figure 9D:
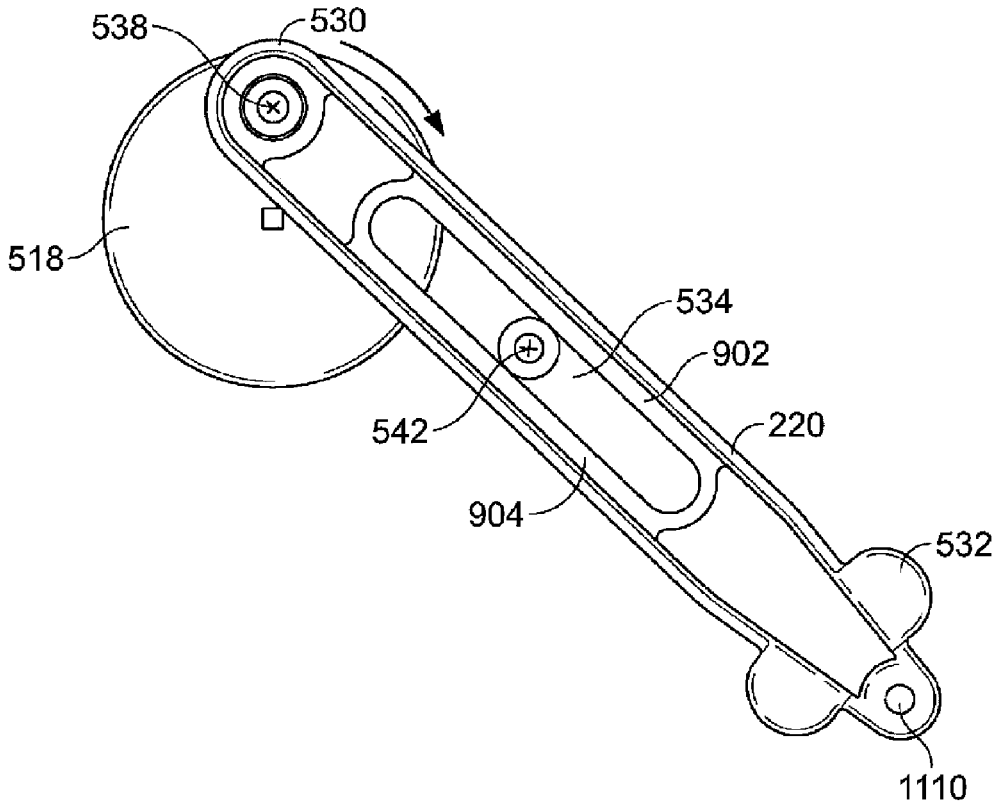
Figure 9E:
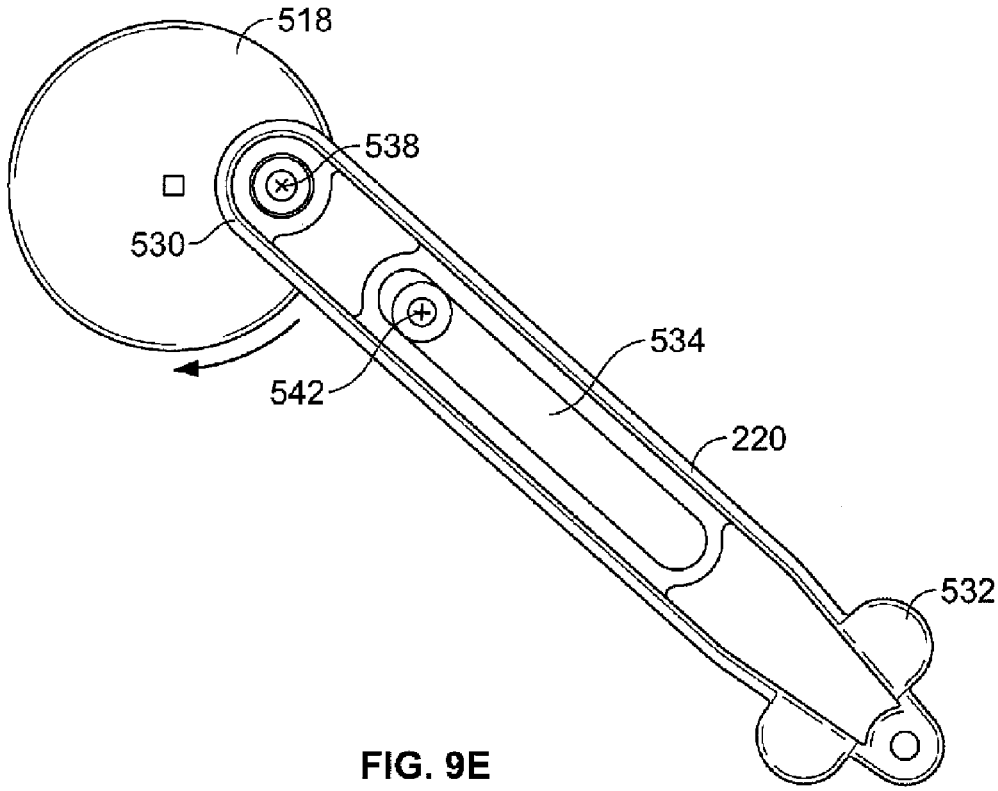
Figure 9F:
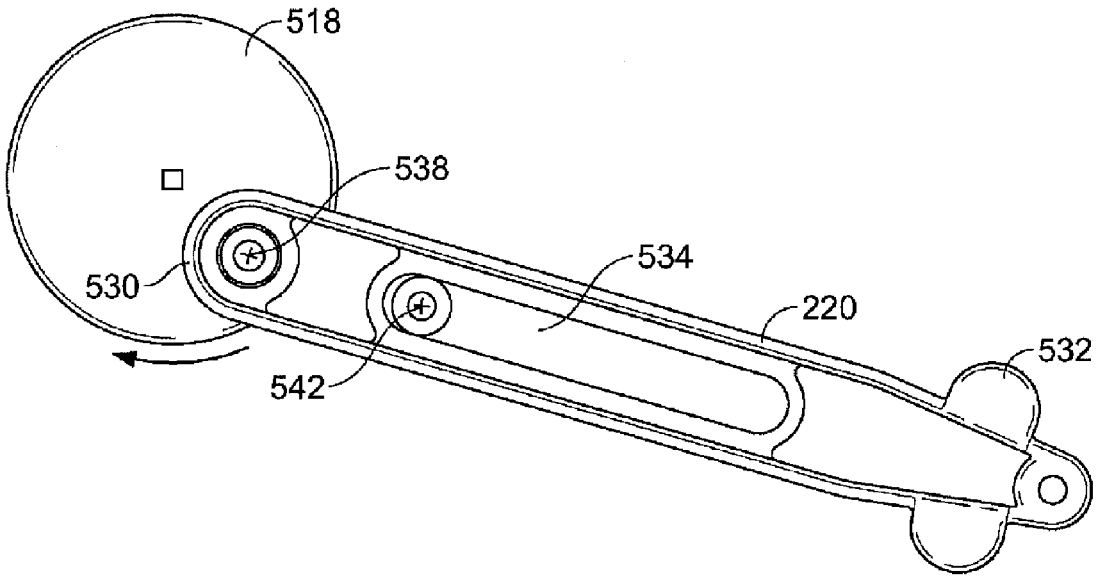
Figure 9G:
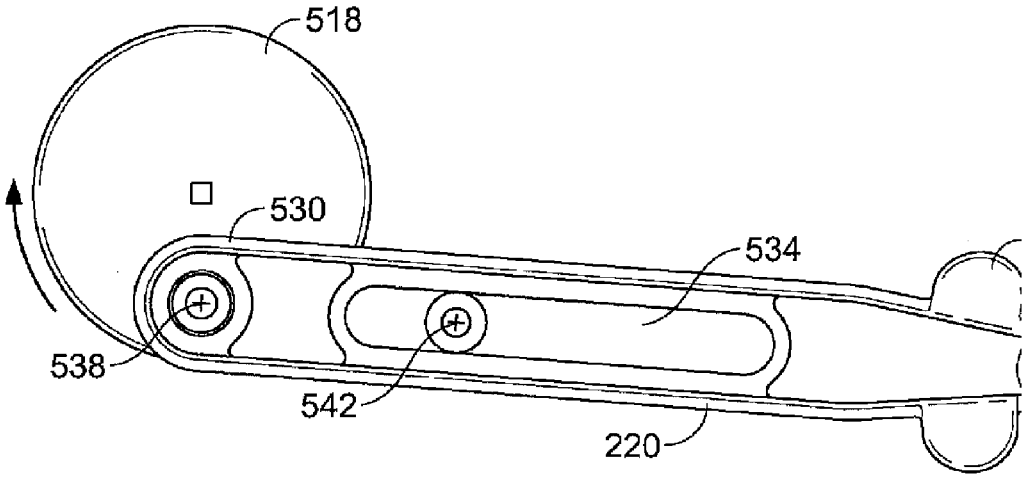

Referring to FIG. 8, the user turns on the toy 100 and the circuitry 402 by actuating the switch 410 (step 802). Upon receipt of a sensed condition (step 804) (for example from an input device 228 or 230), the circuitry 402 actuates the motor 408 (step 806), which actuates some combination of movements of the appendages 220 (step 808), the neck device 222 (step 810), and the tail device 226 (step 812) (described below). To further enhance realism, the circuitry 402 sends a signal to the audio device 404 (step 814) to output a sound such as, for example, a bark, a pant, or a purr, as the motor actuates the combination of movements (steps 808 through 812), Referring also to FIG. 5, actuation of the motor 408 (step 806) causes the motor shaft 512 and the pulley 502 mounted on the shaft 512 to rotate. The rotation of the pulley 502 moves the flexible belt 504, which causes the pulley 506 to rotate. The actuation of pulley 506, in turn, rotates the shaft 514 and thereby rotates the worm gear 508 mounted the shaft 514. The rotating worm gear 508 engages and rotates the gear 520, which actuates the disk shaft 516.

With reference to FIGS. 2B, 5, 6, 7A, and 7B, as mentioned, actuation of the motor 408 (step 806) causes actuation of the neck device (step 810). Rotation of gear 520 on the disk shaft 516 causes the gear 522 to rotate. Rotation of the gear 522 causes the rounded 15 piece 524 and the protrusion 526 on the rounded piece 524 to rotate. The rotation of the protrusion 526 translates into a motion of the lower end of a follower 714, which is attached to the protrusion 526 at the second hole 720. In the present embodiment follower 714 acts as a third rotating device 714. In particular, the motion of the rounded piece 524 drives the protrusion 526, which drives the lower end of the follower 714 in a circular path. An upper end of the follower 714 that includes the first hole 718 describes a radial path that is constrained by the hinge 710 attached to the first hole 718. The motion of the follower 714 moves the neck device 222, which is attached at the third piece 706 to the follower 714 by the bolt 716. The actuation of the neck device 222 moves the head 224, which is attached to the neck device 222. The motion of the follower 714 translates into a reciprocating up and down motion of the neck device 222 and the head 224.

As the motion of the follower 714 reaches its apogee, the neck device 222 and the head 224 are raised, as shown by an arrow 720 in FIG. 7A. As the motion of the follower 714 reaches its perigee, the neck is lowered, as shown by an arrow 722 in FIG. 7B.

As mentioned above, actuation of the motor 408 (step 806) causes actuation of the appendages 220 (step 808). With particular reference to FIGS. 9A-9G, actuation of the 30 driving device 412 results in the simultaneous rotation of the cams 518. In particular, as discussed, the motor 408 rotates the disk shaft 516. The rotation of the disk shaft 516 causes the cams 518 to rotate. Referring to FIGS. 9A-9G, as a cam 518 rotates, the first end 530 of the appendage 220 that is attached to the cam 518 by the eccentric rod 536 and the first screw 538 rotates with the cam 518 in a circular path. As the first end 530 rotates, the motion of the appendage 220 is constrained by the second screw 542 and the fixed linkage rod 540. This limitation arises as a result of the contact of the linkage rod 540 with edges 902 and 904 of the slot 534. Rotation of the first end 530 of the appendages 220 causes the appendage 220 to pivot about and move transversely to the linkage rod 540, which causes the second end 532 to move in a non-circular or irregular path as shown by the sequence of FIGS. 9A-9G.

As mentioned, with reference to FIGS. 6A and 6B, the actuation of the appendages 220 drives the tail device 226.

The inner wall 616 and the outer wall 618 contain the 10 movement of the shaft 610 as the cam 518 rotates relative to the shaft 610. As the circular I portion of the groove 614 rotates and engages the shaft 610, the arm 414 does not move significantly and remains in a default position. As the cam 518 continues to rotate, an upper portion 626 of the shallow u-shaped curve 620 engages the shaft 610, and the long connector piece 414 moves down and inward toward the center of the cam 518 as a result of the dip of the shallow u-shaped curve 620. As the cam 518 continues to rotate, a lower portion 628 of the shallow u-shaped curve 620 engages the shaft 610. As the cam 518 continues to rotate, the lower portion 628 disengages the shaft 610 and the long connector piece 414 moves up and away from the center of the cam 518 and back to its default position.

The movement of the long connector piece 414 towards and away from the center of the cam 518 causes the long connector piece 414 to pull on and release the lower piece 608 of the tail device 226. Movement of the lower piece 608 causes the shaft 604 to rotate, which causes the tail device 226 to rotate. The overall movement of the tail device 226 imparts a realistic appearance of a dog wagging its tail.

Figure 10:
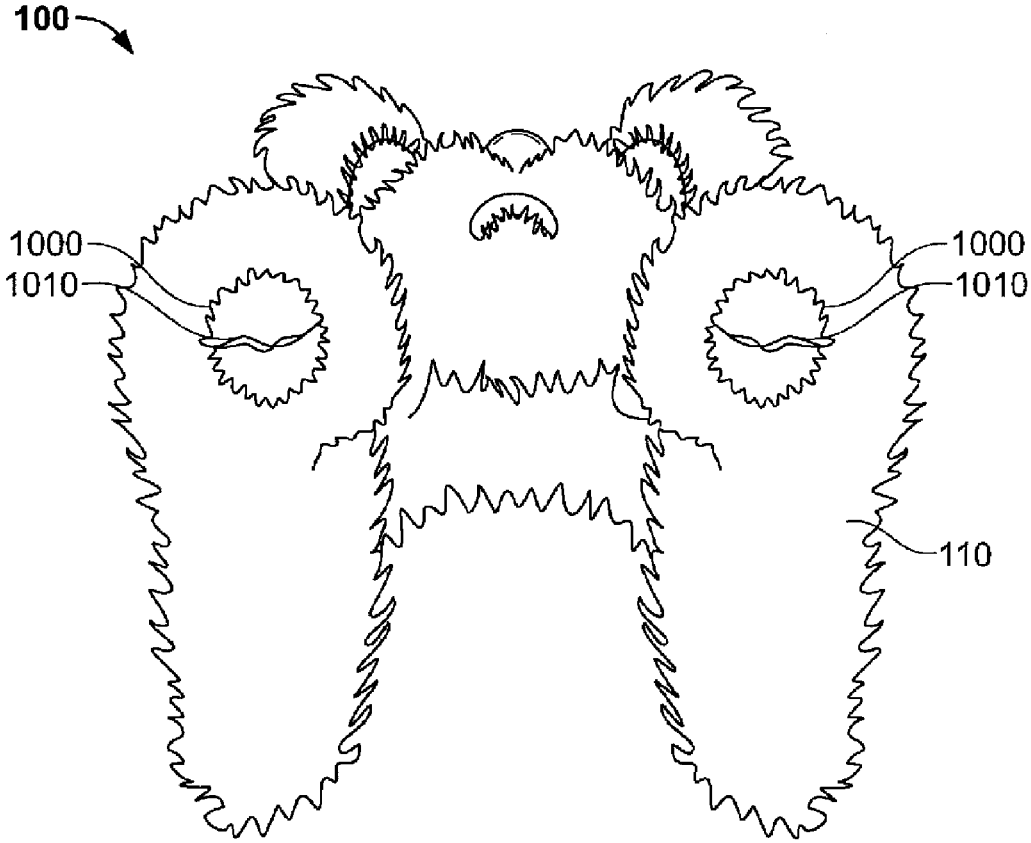
FIG. 10 is a perspective view of an underside of the toy of FIG. 1.
Figure 11A:
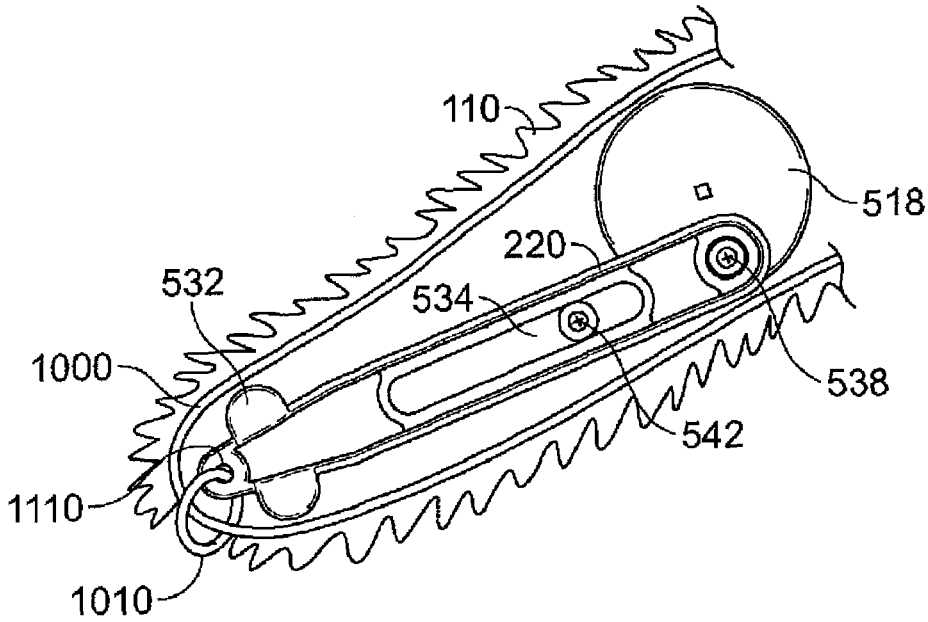
FIGS. 11A and 11B are side and partial cutaway views of the appendage and an external flexible skin of the toy of FIG. 1.
Figure 11B:
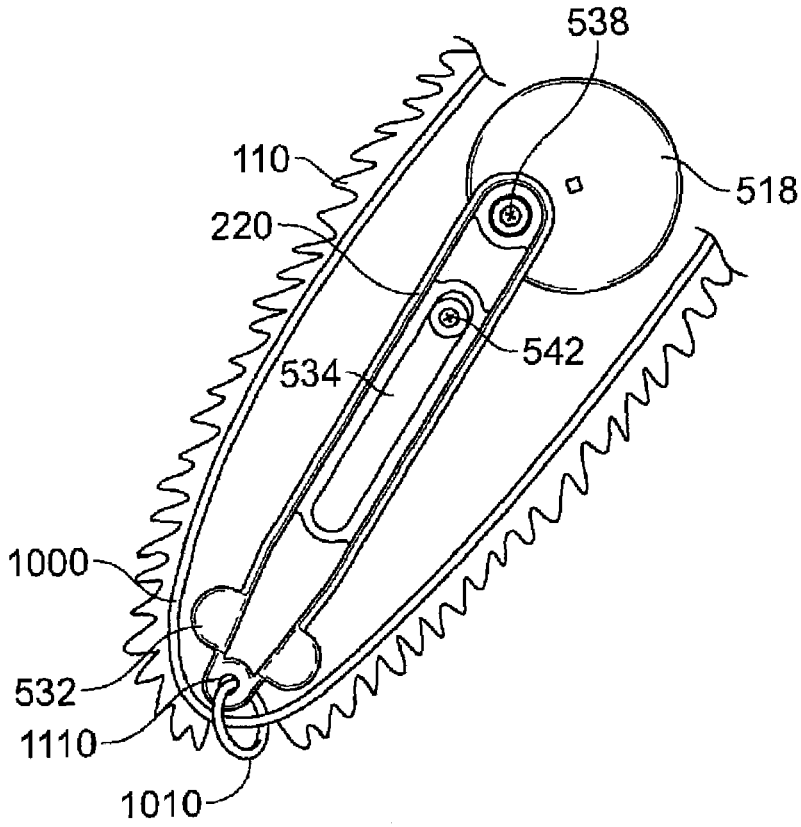

Referring also to FIGS. 10, 11A, and 11B, a portion 1000 of the external flexible skin 110 is fastened to the second end 532 of the appendage 220. For example, the portion 1000 may be sewn with thread 1010 to an eye 110 formed in the second end 532. As the second end 532 traverses the range of motion shown in FIGS. 8A-8G, the portion 1000 of the skin is periodically pulled toward (tensioning) and away from (slackening) the second end 532. This periodic tensioning and slackening causes the skin 110 in the portion 1000 to deform during the cycle. The overall motion of the appendages 220 and the skin 110 of the toy 100 imparts a realistic appearance of a dog moving its paws.

Other implementations are within the scope of the following claims. For example, the toy 100 may be of any design, such as, for example, a toy, a plush toy such as a stuffed animal, a dog or other animal, or a robot.

One or more of the sensors 228 or 230 may be touch-sensitive devices. For example, one or more of the sensors 228 or 230 may be a pressure sensing device such as, for example, a pressure-activated switch in the form of a membrane switch. As another example, a sensor 228 or 230 may be made of a conductive material and may be an inductively-coupled device. In this case, when a user touches the toy 100 at the location of the inductive sensor, a measured inductance associated with the inductive sensor changes and the change is sensed. As a further example, a sensor 228 or 230 may be made of a conductive material and may be a capacitively-coupled device such that when a user touches the toy 100 at the location of the capacitive sensor, a measured capacitance associated with the sensor changes and the change is sensed. One or more of the sensors 228 or 230 may be a light-sensing device, such as, for example, an IR-sensing device or a photocell. Additionally or alternatively, one or more of the sensors 228 or 230 may be a sound-sensing device such as, for example, a microphone.

The output device may be an optical device, such as, for example, a lamp or a light emitting diode, or an electromechanical device. The flexible skin 110 may include a resilient material to further enhance realism of the toy 100.

In another implementation, actuation of the driving device 412 results in an in-phase motion of the appendages 220. Thus, for example, as one appendage 220 reaches an apex of the cycle, the other appendage 220 reaches an apex of the cycle. In another implementation, actuation of the driving device 412 results in an out-of-phase motion of the appendages 220. Thus, for example, as one appendage 220 reaches an apex of the cycle, the other appendage 220 reaches another point of the cycle.

Figure 12:
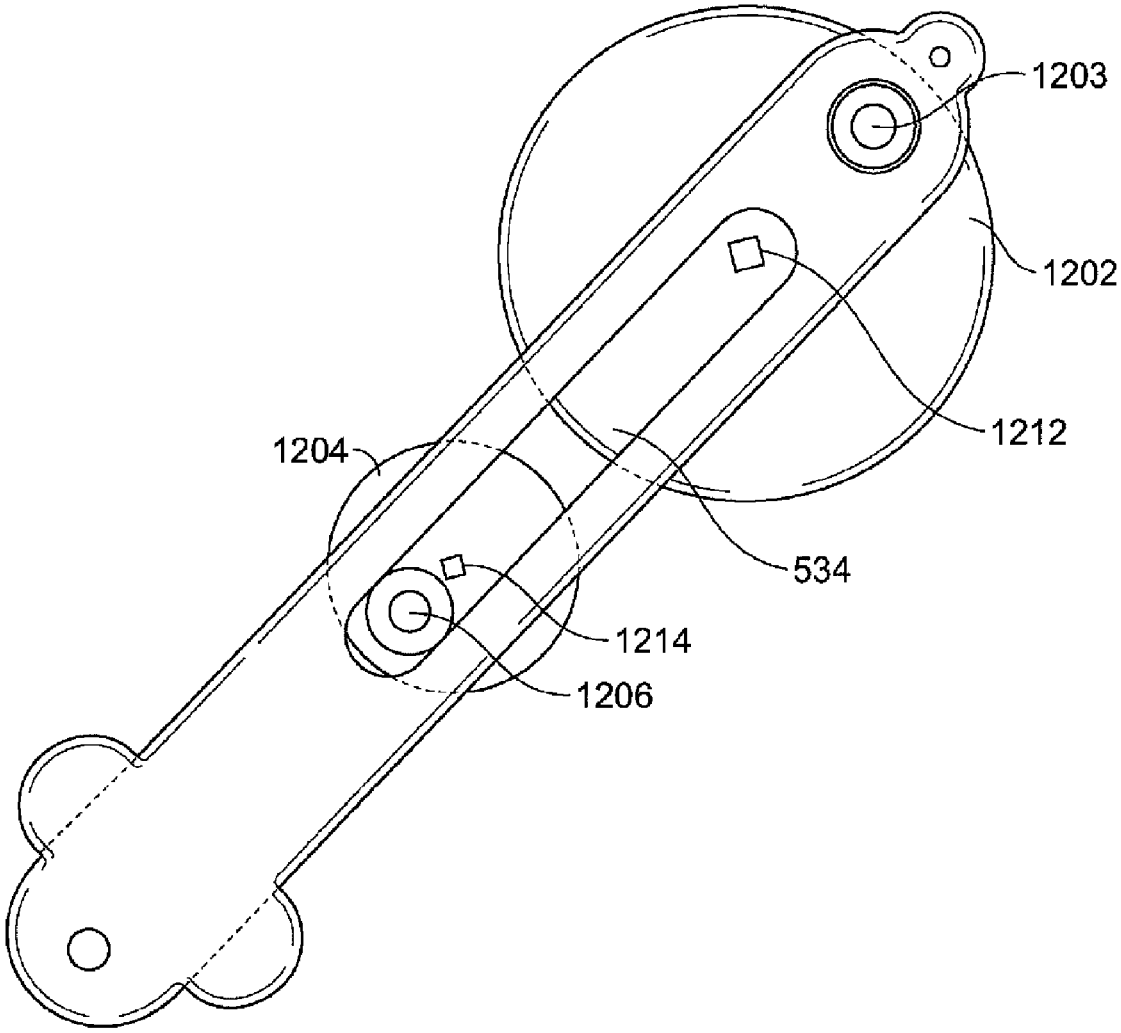
FIG. 12 is a side view of an appendage of the internal structure of the toy of FIG. 2A.

Referring to FIG. 12, in another implementation, the appendages 220 are coupled to the disk shaft 516 with a crank gear 1202 and a pivot gear 1204. The crank gear 1202 includes a center shaft 1212 that is connected to and driven by the disk shaft 516. The appendage 220 is rotatably fixed to the crank gear 1202 at a point 1203. The pivot gear 1204 includes a center post 1214 rotatably mounted to the body 214 and teeth that mesh with teeth of the crank gear 1202. The pivot gear 1204 includes a post 1206 that is rotatably and slidably received within the slot 534 of the appendage 220.

In operation, the disk shaft 516 drives the crank gear 1202, which in turn drives the pivot gear 1204. The motion of the pivot gear 1204 allows the post 1206 in the slot 534 to move back and forth through the slot 534 about an arc defined by the shape of the slot 534. The resulting motion moves the appendage 220 through a path that is repeatable for every one revolution of the crank gear 1202.

The pivot gear 1204 may have half the number of gear teeth as the crank gear 1202, such that the pivot gear 1204 operates at twice the speed of the crank gear 1202. Thus, as the pivot gear 1204 completes one revolution, the crank gear 1204 completes one half of a revolution.

It should be appreciated that a wide range of changes and modifications may be made to the embodiments of the inventions as described herein. It is intended that the foregoing detailed description be regarded as illustrative rather than limiting. While there have been illustrated and described particular embodiments of the inventions, it will be appreciated that numerous changes and modifications will occur to those skilled in the art, and it is intended in the appended claims to cover those changes and modifications which fall within the true spirit and scope of the present invention.

What is claimed is:

1. A toy comprising:

a head;

a body that can directly contact a horizontal support surface;

a neck connecting the head to the body;

a pair of front feet connected to the body, said feet having a surface that partly contacts the horizontal support surface;

an information processor: and a switch located at the connection of the head and the neck between the neck and the head and operable responsive to activation of said switch by movement of the head relative to the neck with the information processor for activating said feet to raise and lower the body with the surface of said feet that partly contacts the horizontal support surface.

2. A toy as recited in claim 1, wherein said switch is operable with the information processor for activating said feet to raise and lower the body exhibiting a tugging motion by raising and lowering of the body in coordination with the switch.

3. A toy as recited in claim 1, wherein the activating of said feet with the switch between the neck and the head results in the toy exhibiting a tugging motion by raising and lowering of the body in coordination with the switch.

4. A toy as recited in claim 3, comprising an audio system providing sound effects in coordination with the switch.

* * * * *